US010760577B2

(12) United States Patent
Maurino et al.

(10) Patent No.: US 10,760,577 B2
(45) Date of Patent: Sep. 1, 2020

(54) SPRING REGULATED VARIABLE FLOW ELECTRIC WATER PUMP

(71) Applicant: Magna Powertrain, Inc., Concord (CA)

(72) Inventors: Paolo Lincoln Maurino, Bagnolo Piemonte (IT); Ernesto Giovanni Arnoldi, Luserna S. Giovanni (IT)

(73) Assignee: MAGNA POWERTRAIN FPC LIMITED PARTNERSHIP, Aurora, Ontario (CA)

( * ) Notice: Subject to any disclaimer, the term of this patent is extended or adjusted under 35 U.S.C. 154(b) by 0 days.

(21) Appl. No.: 16/251,444

(22) Filed: Jan. 18, 2019

(65) Prior Publication Data

US 2019/0162190 A1 May 30, 2019

Related U.S. Application Data

(63) Continuation of application No. 15/079,123, filed on Mar. 24, 2016, now abandoned.

(Continued)

(51) Int. Cl.

| | |
|---|---|
| ***F04D 15/00*** | (2006.01) |
| ***F04D 29/042*** | (2006.01) |
| ***F04D 13/06*** | (2006.01) |
| ***F01P 7/16*** | (2006.01) |
| ***F01P 3/20*** | (2006.01) |
| *F01P 3/00* | (2006.01) |

(52) U.S. Cl.

CPC ..... *F04D 15/0038* (2013.01); *F01P 3/20* (2013.01); *F01P 7/164* (2013.01); *F04D 13/06* (2013.01); *F04D 15/0027* (2013.01); *F04D 29/042* (2013.01); *F01P 2003/001* (2013.01); *F01P 2050/22* (2013.01); *F05D 2270/42* (2013.01)

(58) Field of Classification Search

CPC .... F04D 29/041; F04D 29/042; F04D 29/052; F04D 15/0027; F04D 15/0038; F04D 13/06; F05D 2270/42; F01P 7/164; F01P 3/20; F01P 2050/22; F01P 2203/001

See application file for complete search history.

(56) References Cited

U.S. PATENT DOCUMENTS 3,918,831 A 11/1975 Grennan
4,752,183 A * 6/1988 Sakurai ..... F04D 29/042 415/12

(Continued)

FOREIGN PATENT DOCUMENTS

DE 2510787 A1 * 9/1976 ..... F04D 15/0022
DE 2510787 A1 9/1976

(Continued)

OTHER PUBLICATIONS

Extended European Search Report dated Aug. 24, 2016 in corresponding European Patent Application No. 16161763.4.

(Continued)

*Primary Examiner* — Devon C Kramer
*Assistant Examiner* — Christopher J Brunjes
(74) *Attorney, Agent, or Firm* — Dickinson Wright PLLC

(57) ABSTRACT

An electric water pump having a motor with an axially moveable rotor unit. A rotary pump member is fixed for axial movement with the rotor unit to vary its position within a pump chamber so as to vary the flow rate through the pump chamber.

8 Claims, 7 Drawing Sheets

Related U.S. Application Data

(60) Provisional application No. 62/140,854, filed on Mar. 31, 2015.

(56) References Cited

U.S. PATENT DOCUMENTS

| | | | | |
|---|---|---|---|---|
| 4,828,454 | A | 5/1989 | Morris et al. | |
| 5,800,120 | A * | 9/1998 | Ramsay | F04D 15/0038 415/129 |
| 7,789,049 | B2 | 9/2010 | Duley | |
| 2010/0006044 | A1 * | 1/2010 | Duley | F01P 5/12 123/41.02 |
| 2011/0144744 | A1 * | 6/2011 | Wampler | A61M 1/122 623/3.13 |
| 2012/0145203 | A1 * | 6/2012 | Watson | A47L 15/4204 134/110 |
| 2013/0259720 | A1 | 10/2013 | Mills et al. | |
| 2014/0017073 | A1 | 1/2014 | Muizelaar et al. | |

FOREIGN PATENT DOCUMENTS

| | | | |
|---|---|---|---|
| DE | 102005056199 | A1 | 10/2006 |
| EP | 2818725 | A1 | 12/2014 |
| GB | 682654 | A | 11/1952 |

OTHER PUBLICATIONS

Office Action dated Apr. 3, 2018 in corresponding European Patent Application No. 16161763.4.

* cited by examiner

SPRING REGULATED VARIABLE FLOW ELECTRIC WATER PUMP

CROSS REFERENCE TO RELATED APPLICATIONS

This application is a Continuation of U.S. application Ser. No. 15/079,123 filed Mar. 24, 2016 which claims the benefit of U.S. Provisional Application No. 62/140,854 filed Mar. 31, 2015. The entire disclosure of each of the above applications is incorporated herein by reference.

FIELD

The present disclosure relates generally to water pumps for motor vehicles. More specifically, the present disclosure relates to a variable flow electric water pump equipped with an axially-moveable rotor/impeller assembly.

BACKGROUND

This section provides background information related to the present disclosure which is not necessarily prior art.

As is well known, water pumps are typically used in motor vehicles as part of a thermal management system for pumping a liquid coolant to facilitate heat transfer between the coolant and the internal combustion engine during vehicle warm-up and operation. Most commonly, a centrifugal water pump having a rotary pump member, such as an impeller, is configured to draw the coolant into an axial inlet and discharge the coolant through a radial discharge outlet. In many vehicular arrangements, the impeller is fixed to an impeller shaft that is rotatably driven (via an accessory drive system) by the crankshaft of the engine. Thus, the impeller speed is directly proportional to the engine speed. To provide a variable flow feature to such shaft-driven water pumps, it is known to permit limited axial displacement of the impeller within the pump chamber. For example, U.S. Pat. No. 7,789,049 discloses a water pump having an axially-moveable impeller that is spline mounted to the engine-driven shaft, and an electromagnetic actuator operable to control axial movement of the impeller between extended and retracted positions along the shaft so as to variably regulate the fluid flow characteristic between the fluid inlet and the discharge outlet. Similarly, U.S. Pat. No. 5,800,120 discloses a water pump having a shaft-driven impeller equipped with axially-moveable blades, the position of which is controlled via a hydraulic actuator.

It is also well known to install an auxiliary water pump, such as an electric water pump, in the engine coolant system to provide augmented control over the fluid flow. Generally, electric water pumps include an electric motor having a stationary stator and a rotor that is drivingly coupled to the impeller. Examples of electric water pumps are disclosed in commonly-owned U.S. Publication No. US2013/0259720 titled "Electric Water Pump With Stator Cooling" and U.S. Publication No. US2014/0017073 titled "Submerged Rotor Electric Water Pump with Structural Wetsleeve", the entire disclosures of which are incorporated herein by reference. One drawback associated with many conventional electric water pumps is the need to provide a rotor encoder or another type of speed sensor within the electric motor to assist in accurate low speed (i.e. less than 600 RPM) pump control via a closed loop motor control system. Additionally, a need exists to provide variable flow at such low speeds that is not directly proportional to motor speed in an effort to meet customer expectations.

In view of the above, a need exists in the art to design and develop simplified and low-cost electric water pumps capable of providing variable flow characteristics and which can be easily substituted for otherwise conventional electric water pumps in motor vehicle applications.

SUMMARY

This section provides a general summary of the disclosure and is not intended to act as a comprehensive and exhaustive disclosure of its full scope or all of its features, advantages, objectives and aspects.

It is an objective of the present disclosure to provide an electric water pump that meets the above-identified needs and provides a technological advancement over conventional electric water pumps.

It is another objective of the present disclosure to provide an electric water pump equipped with an electric motor having a stationary stator assembly and an axially-moveable rotor unit adapted to cause concurrent axial movement of a rotary pump member within a pump chamber for variably regulating fluid flow between an inlet and an outlet communicating with the pump chamber.

It is similar objective of the present disclosure to provide an electric water pump having a rotor/impeller assembly that is axially moveable relative to a stationary stator assembly for varying the size of a clearance gap between a volute in the pump chamber and the impeller.

It is a related objective of the present disclosure to control movement of the rotor/impeller assembly so as to provide a low flow output at low rotor speeds and a high flow output at high rotor speeds. In this regard, the rotor/impeller assembly is located in a low flow position relative to the stator assembly when rotated at low rotor speeds and in a high flow position relative to the stator assembly when rotated at high rotor speeds.

In accordance with a first embodiment of an electric water pump constructed and functional in accordance with the objectives of the present disclosure, the rotor/impeller assembly is normally biased toward its low flow position by a mechanical biasing arrangement disposed between the rotor unit and a stationary member within a pump housing. Movement of the rotor/impeller assembly from its low flow position toward its high flow position is a result of a pressure differential ($\Delta P$) generated between upper (i.e. outer) and lower (i.e. inner) portions of the impeller and which is a function of the rotary speed of the rotor/impeller assembly.

In accordance with a second embodiment of an electric water pump constructed and functional in accordance with the objectives of the present disclosure, the rotor/impeller assembly is normally located in its low flow position by a magnetic biasing arrangement provided by an axially-offset magnetic field between the stator assembly and the rotor unit that is established by rotor magnets having an increased length in the direction of the impeller so as to provide a centering relationship with the stator assembly during low speed operation.

The present disclosure is directed to a variable flow electric water pump for use in an engine coolant system of a motor vehicle comprising: a pump housing defining a fluid chamber and a motor chamber, the fluid chamber including a fluid inlet and a discharge outlet for providing a flow of a coolant through the fluid chamber; an electric motor disposed in the motor chamber and including a stationary stator assembly and a rotor unit having a rotor shaft supported for rotation about a longitudinal axis and at least partially extending into the fluid chamber; an impeller fixed for rotation with the rotor shaft and disposed within the fluid chamber and being operable to pump the coolant from the fluid inlet to the discharge outlet; and a biasing arrangement operable for normally locating the rotor unit in a first position axially offset relative to the stator assembly for locating the impeller in a retracted position within the fluid chamber so as to provide a low flow characteristic between the fluid inlet and the discharge outlet when the impeller is rotatable driven by the rotor shaft at a low impeller speed.

The variable flow electric water pump of the present disclosure is further operable when the impeller is rotatably driven at a higher impeller speed to forcibly move the impeller to an extended position within the fluid chamber, in opposition to the preload exerted by biasing arrangement, for causing the rotor unit to be located in a second position axially aligned with the stator assembly.

The variable flow electric water pump of the present disclosure can be equipped with a mechanical biasing arrangement configured to normally exert a biasing force on the rotor unit selected to bias the rotor unit toward its first position. The mechanical biasing arrangement can include a mechanical biasing member, such as one or more spring members, disposed between an upper portion of the rotor unit and a stationary member or portion of the pump housing.

The variable flow electric water pump of the present disclosure can optionally be equipped with a magnetic biasing arrangement configured to normally locate the rotor unit in its first position.

The variable flow electric water pump of the present disclosure can further include an interface formed in the pump housing between the fluid inlet and the discharge outlet defining a flange surface. The impeller can be configured to include an outer rim surfaced aligned with the flange surface such that a first larger clearance gap is established therebetween when the impeller is located in its retracted position. The first larger clearance gap functions to establish a low flow characteristic when the impeller is driven at the low impeller speeds by the electric motor. In contrast, a second smaller clearance gap is established when the impeller is located in its extended position so as to create a high flow characteristic when the impeller is driven by the electric motor at the high impeller speeds.

Further areas of applicability will become apparent from the detailed description provided herein. As noted, the description of the objectives, aspects, features and specific embodiments disclosed in this summary are intended for purposes of illustration only and are not intended to limit the scope of the present disclosure.

DRAWINGS

The drawings described herein are for illustrative purposes only of selected embodiments and not all possible implementations and, as such, are not intended to limit the scope of the present disclosure.

Corresponding reference numerals indicate corresponding components throughout the several views of the drawings.

DETAILED DESCRIPTION

Example embodiments will now be more fully describe with reference to the accompanying drawings. However, the following description is merely exemplary in nature and is not intended to limit the present disclosure, its subject matter, applications or uses. To this end, example embodiments of an electric water pump are provided so that this disclosure will be thorough and will fully convey the scope to those skilled in this art. Numerous specific details are set forth, such as examples of specific components, devices and methods to provide a thorough understanding of the embodiments in many different forms, and such should not be construed to limit the intended scope of protection afforded by this disclosure. As is understood, some well-known processes, structures and technologies are not described in detail herein in view of the understanding afforded thereto by those skilled in this art.

In general, the present disclosure relates to an electric pump and, more particularly, to an electric water pump of the type applicable and well-suited for use and installation in motor vehicles for pumping a liquid coolant through an engine cooling system. However, the teachings provided herein are considered to be adaptable to any other electric pump required to move a medium (i.e. air, water, coolant, oil, etc.) within a pumping system requiring a variable flow capability.

Figure 1:
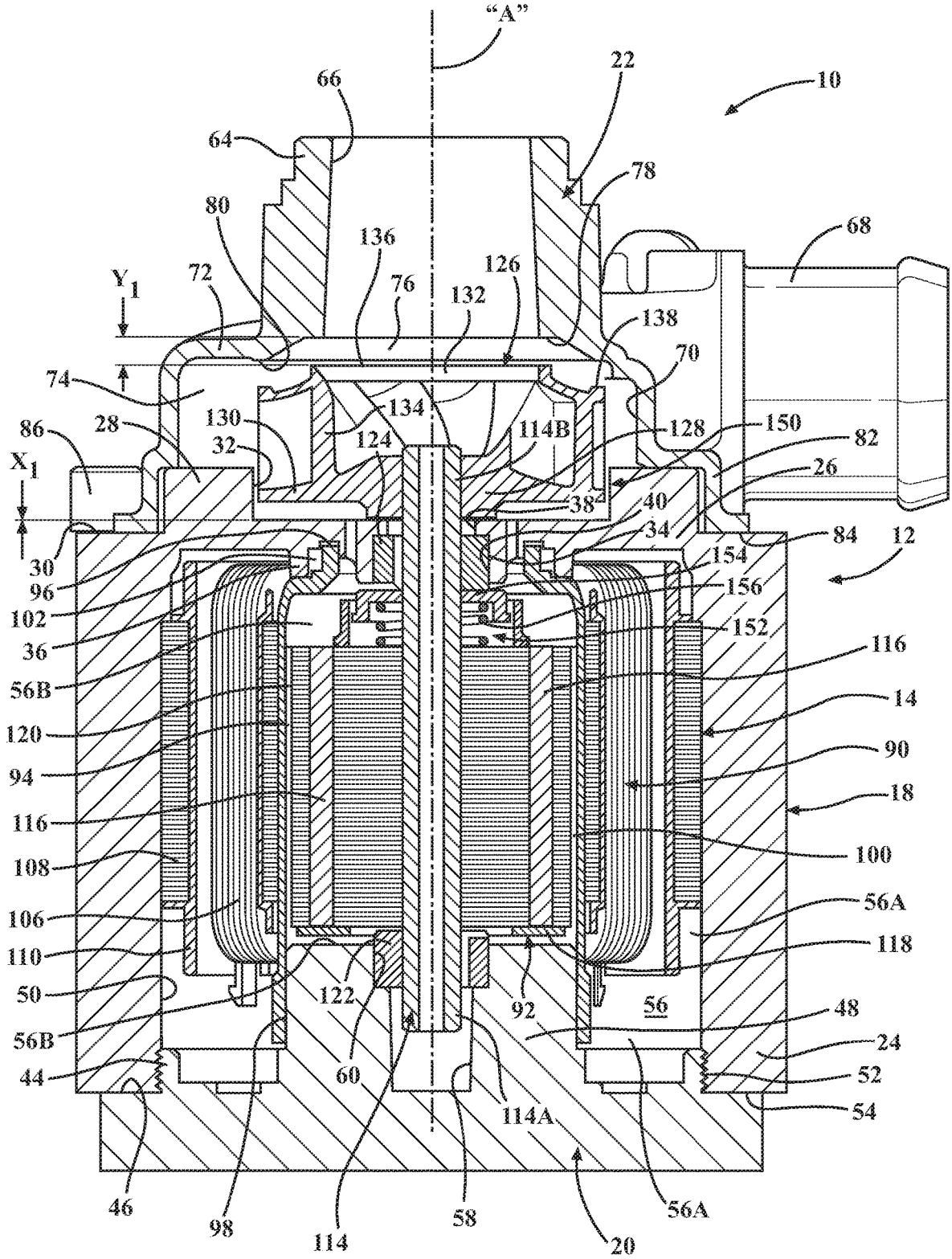
FIG. 1 is a sectional view of a variable flow electric water pump constructed in accordance with a first embodiment of the present disclosure to include a mechanically-biased rotor/impeller assembly which is shown located in a first or low flow position relative to a stationary stator assembly.
Figure 2:
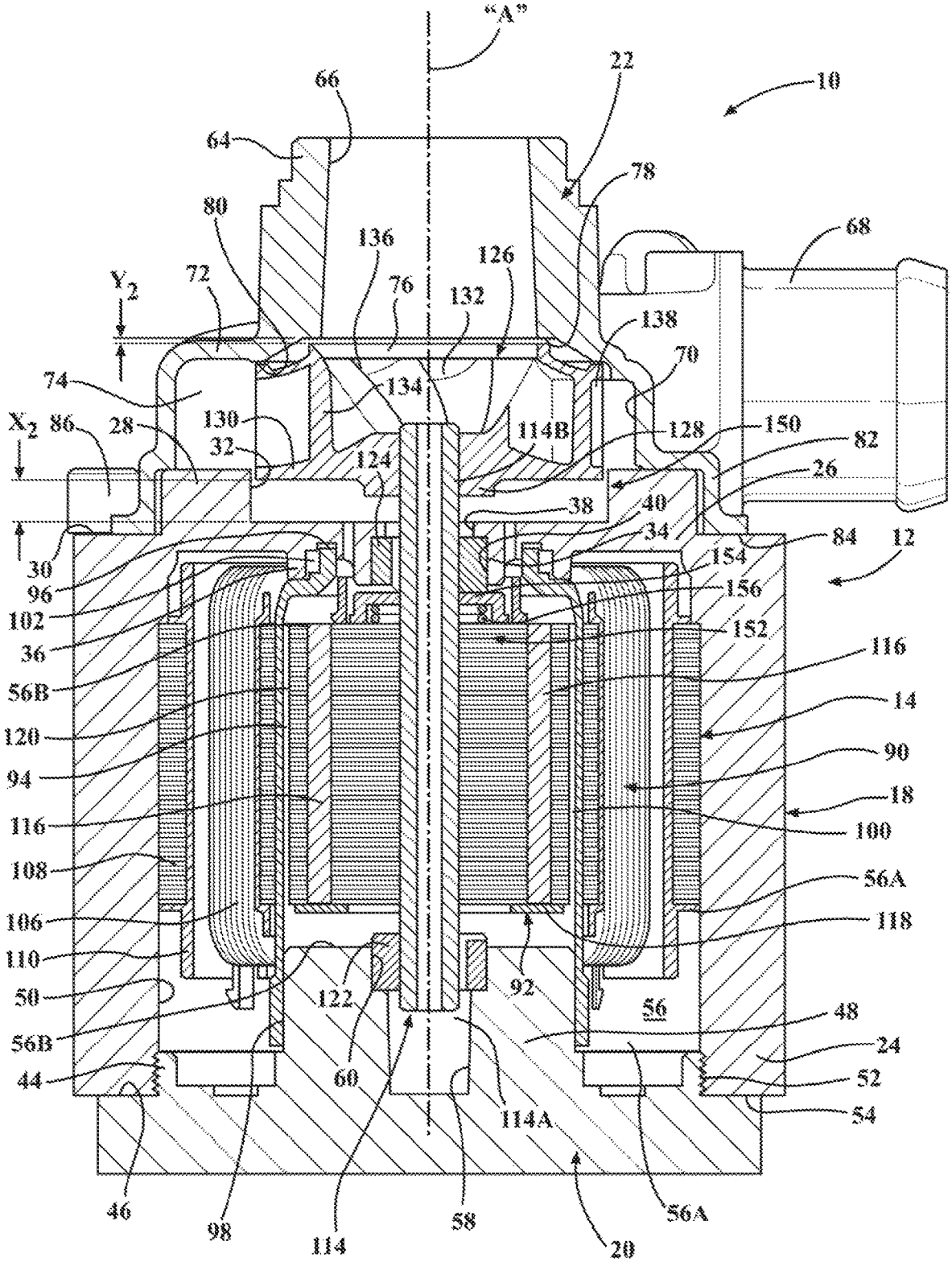
FIG. 2 is another sectional view of the variable flow electric water pump shown in FIG. 1 now illustrating the spring-biased rotor/impeller assembly located in a second or high flow position relative to the stator assembly.

With particular reference to FIGS. 1 and 2 of the drawings, an electric water pump 10 constructed and functional in accordance with a first example embodiment of the present disclosure will now be described in greater detail. Pump 10 generally includes a pump housing 12, an electric motor 14, and a pump unit 16. Pump housing 12 is shown in this non-limiting example to include a cylindrical outer housing 18, a first or bottom cap 20, and a second or top cap 22. Outer housing 18 is generally cup-shaped and includes an open end section 24 to which bottom cap 20 is secured, and an end plate section 26 to which top cap 22 is secured. End plate section 26 of outer housing 18 is formed to define a raised annular rim 28 extending from a planar mounting surface 30. A central pump pocket 32 is formed in rim 28 and is aligned on the longitudinal axis "A" of pump 10. A pair of internal annular bosses 34 and 36 also extend from end plate section 26 of outer housing 18 and are aligned with the longitudinal axis. A thorough bore 38 extends between pump pocket 32 and a bearing pocket 40 associated with annular boss 34.

Bottom cap 20 is configured, in this non-limiting example, to include an annular rim 44 extending from a planar mounting surface 46, and an elongated cylindrical hub 48, both of which are concentric with the longitudinal axis. End section 24 of outer housing 18 includes an inner diameter wall surface 50 configured to be pressed against an outer diameter surface 52 of annular rim 44. End section 24 also includes a planar end surface 54 configured to engage mounting surface 46 on bottom cap 20. While not specifically shown, a suitable fastening arrangement is provided to secure bottom cap 20 to outer housing 18 so as to define an internal motor chamber 56. A blind bore 58 is formed in hub 48 and further defines a bearing pocket 60.

Top cap 22 is shown, in this non-limiting example, configured to include an axially-extending tubular section 64 defining a fluid inlet 66, a radially-extending tubular section 68 defining a fluid discharge outlet 70, and a volute section 72 defining an impeller cavity 74 in fluid communication with fluid inlet 66 and discharge outlet 70. An interface 76 is formed in top cap 22 between fluid inlet 66 and impeller cavity 74 and includes a first flange surface 78 and a second flange surface 80. Top cap 22 includes a stepped flange section 82 configured to enclose a portion of raised rim 28 on end plate section 26 of outer housing 18. Top cap 22 also includes a planar inner mounting surface 84 configured to engage outer mounting surface 30 on outer housing 18. Suitable fasteners, such as a plurality of bolts 86, are provided for securely connecting top cap 22 to outer housing 18.

With continued reference to FIGS. 1 and 2, electric motor 14 is generally shown, in this non-limiting example, to include a stator assembly 90, a rotor unit 92, and a sleeve 94. Sleeve 94 has a first end section 96 engaging end plate section 26 of outer housing 18, a second end section 98 surrounding a portion of hub 48 on bottom cap 20, and an elongated intermediate sleeve section 100 therebetween. An O-ring seal 102 is provided between annular rim 36 of end plate section 26 and first end section 96 of sleeve 94. Sleeve 94 is configured to delineate motor chamber 56 into a toroidal stator cavity 56A and a cylindrical rotor cavity 56B. Stator assembly 90 is located within stator cavity 56A and is configured to be non-moveable (i.e. stationary) therein. Rotor unit 92 is located within rotor cavity 56B and is configured to be both rotatable and axially moveable therein, as will be detailed hereinafter with greater specificity.

Stator assembly 90 includes, in this non-limiting example, a coil winding 106 and a plurality or stack of plates 108 retained on a stator cage 110. Stator cage 110 in non-moveably mounted to outer housing 18 and/or sleeve 94 within stator cavity 56A.

Rotor unit 92 is shown, in this non-limiting example, to include a rotor shaft 114 and a plurality of circumferentially-aligned permanent magnets 116 retained by or encapsulated in a rotor shell 118. An annular magnetic air gap 120 is established between intermediate sleeve segment 100 of sleeve 94 and rotor unit 92. The components of rotor unit 92 are fixed to rotor shaft 114 for common rotation about the longitudinal axis. A first or lower end portion 114A of rotor shaft 114 is disposed in blind bore 58 formed in bottom cap 20 and is supported for rotary and axial movement therein by a first or lower guide bushing 122 retained in bearing pocket 60. Likewise, a second or upper end portion 114B of rotor shaft 114 extends through throughbore 38 and into impeller cavity 74. End portion 114B of rotor shaft 114 is supported for rotary and axial movement by a second or upper guide bushing 124 retained in bearing pocket 40 formed in annular boss 34.

Pump unit 16 is shown, in this non-limiting example, to include a rotary pump member, such as an impeller 126, that is rigidly fixed to second end portion 114B of rotor shaft 114 for rotation within pump pocket 32. Impeller 126 is configured to include a central hub segment 128, a first or lower rim segment 130 extending radially from hub segment 128, a second or upper rim segment 132, and a plurality of contoured impeller blades 134 extending between lower rim segment 130 and upper rim segment 132. The actual number of impeller blades 134 and their particular contoured configuration (i.e. profile, shape, thickness, etc.) can be selected to provide the desired flow characteristic for a specific pump application. Upper rim segment 132 is configured to define a first rim surface 136 that is generally aligned with first flange surface 78 of volute interface 76, and define a second rim surface 138 that is generally aligned with second flange surface 80.

In accordance with the present disclosure, a rotor/impeller assembly 150 (comprised of rotor unit 92, rotor shaft 114 and impeller 126) is moveable axially with respect to stator assembly 90 and inlet/volute interface 76 to provide a means for varying the flow characteristics of pump 10. In this regard, FIGS. 1 and 2 further illustrate pump 10 to include a mechanical biasing arrangement 152 acting between rotor unit 92 and a stationary component or portion of pump housing 12. In particular, mechanical biasing arrangement 152 is shown, in the non-limiting example, to include a thrust washer 154 fixed to annular boss 34 (or abutting guide bushing 124) and a biasing member 156 acting between thrust washer 154 and an upper portion of rotor unit 92. In the non-limiting example shown, biasing member 156 is a helical coil spring surrounding rotor shaft 114 and configured to apply a predefined spring load (i.e. "preload") on rotor unit 92 for normally biasing rotor unit 92 toward a first position within rotor cavity 56B, as shown in FIG. 1. In this first position, rotor unit 92 is axially offset relative to stator assembly 90. Since impeller 126 is fixed via rotor shaft 114 to rotor unit 92, impeller 126 is located in a "retracted" position when rotor unit 92 is located in its first position. As such, rotor/impeller assembly 150 is defined to be located in a "low flow" position within pump 10.

As seen in FIG. 1, with rotor/impellor assembly 150 located in its low flow position, a small clearance "$X_1$", is established between a lower surface 140 of impeller hub 128 and a bottom surface 142 of impeller pocket 32. In contrast, a large clearance "$Y_1$" is established between corresponding interface surfaces 78, 80 and impeller rim surfaces 136, 138. The preload provided by biasing member 156 is selected to establish this offset relationship shown in FIG. 1 between stator assembly 90 and rotor unit 92 when the rotor shaft speeds are low so as to increase the clearance gap "Y" between impeller 126 and volute interface 76 to intentionally provide decreased pump efficiency and reduced flow.

In contrast to the arrangement shown in FIG. 1, FIG. 2 illustrates pump 10 when rotor shaft 114 is driven at a higher rotary speed. Specifically, when impeller 126 is rotated at higher speeds, a fluid pressure differential across impellor 126 acts to compress biasing member 156 which permits axial movement of rotor/impeller assembly 150 to a "high-flow" position (FIG. 2). With rotor/impeller assembly 150 located in its high flow position, rotor unit 92 is located in a second position relative to stator assembly 90 and impeller 126 is located in an "extended" position relative to volute interface 76. In its second position, rotor unit 92 is axially aligned with stator assembly 90 such that a large clearance "$X_2$" is established between lower surface 140 of impeller hub 128 and bottom surface 142 of impeller pocket 32 while, concomitantly, a small clearance "$Y_2$" is established between corresponding interface surfaces 78, 80 and impeller rim surfaces 136, 138. The counterforce generated to oppose and overcome the preload of biasing member 156 is a result of the pressure differential (ΔP) generated when impeller 126 is rotated at higher speed.

Figure 3:
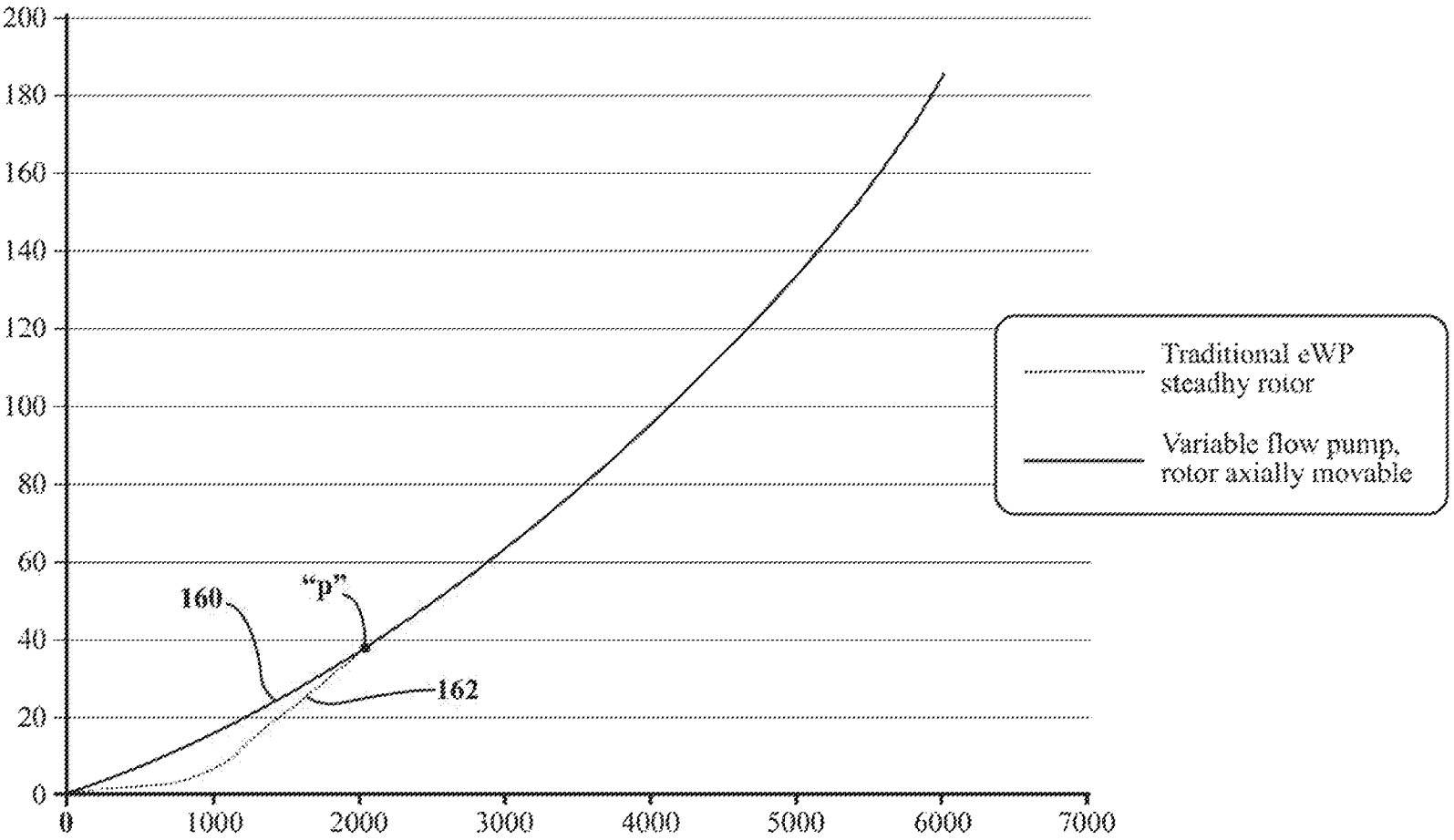
FIG. 3 is a graph illustrating the low-speed flow characteristics provided by the variable flow electric water pump shown in FIGS. 1 and 2 in comparison to a conventional fixed flow electric water pump.

In one non-limiting example, the clearance gap "$Y_1$" is in the range of 3 to 5 mm at low impellor rotary speeds in the range of 400 to 600 RPM. In contrast, the clearance gap "$Y_2$" is in the range of 0.3 to 0.6 mm at higher impellor rotary speeds. FIG. 3 provides a graphical illustration of the flow vs speed characteristics for a conventional electric water pump with a fixed rotor/impeller assembly (see line 160) in comparison to pump 10 of the present disclosure (see line 162). What is evident is that the reduced efficiency provided by spring-biasing rotary/impeller assembly 150 to its low flow position (FIG. 1) results in reduced flow rates (LPM) at lower pump speeds. The illustration further illustrates that upon movement of rotor/impeller assembly 150 to its high flow position (FIG. 2), the flow vs. speed characteristics of pump 10 tend to align with those of the conventional pump, identified in this non-limiting example as point "P".

Based on the above, the present disclosure provides a unique and non-obvious variant of an electric water pump 10 that is configured to generate lower flow at low rotor speeds as well as generate high flow at higher rotor speeds. It is contemplated that the preload applied by biasing member 156 to rotor unit 92 can be calibrated based on pump speed so as to maintain rotor/impeller assembly 150 in its low flow position until increased pumping efficiency is required.

Figure 4:
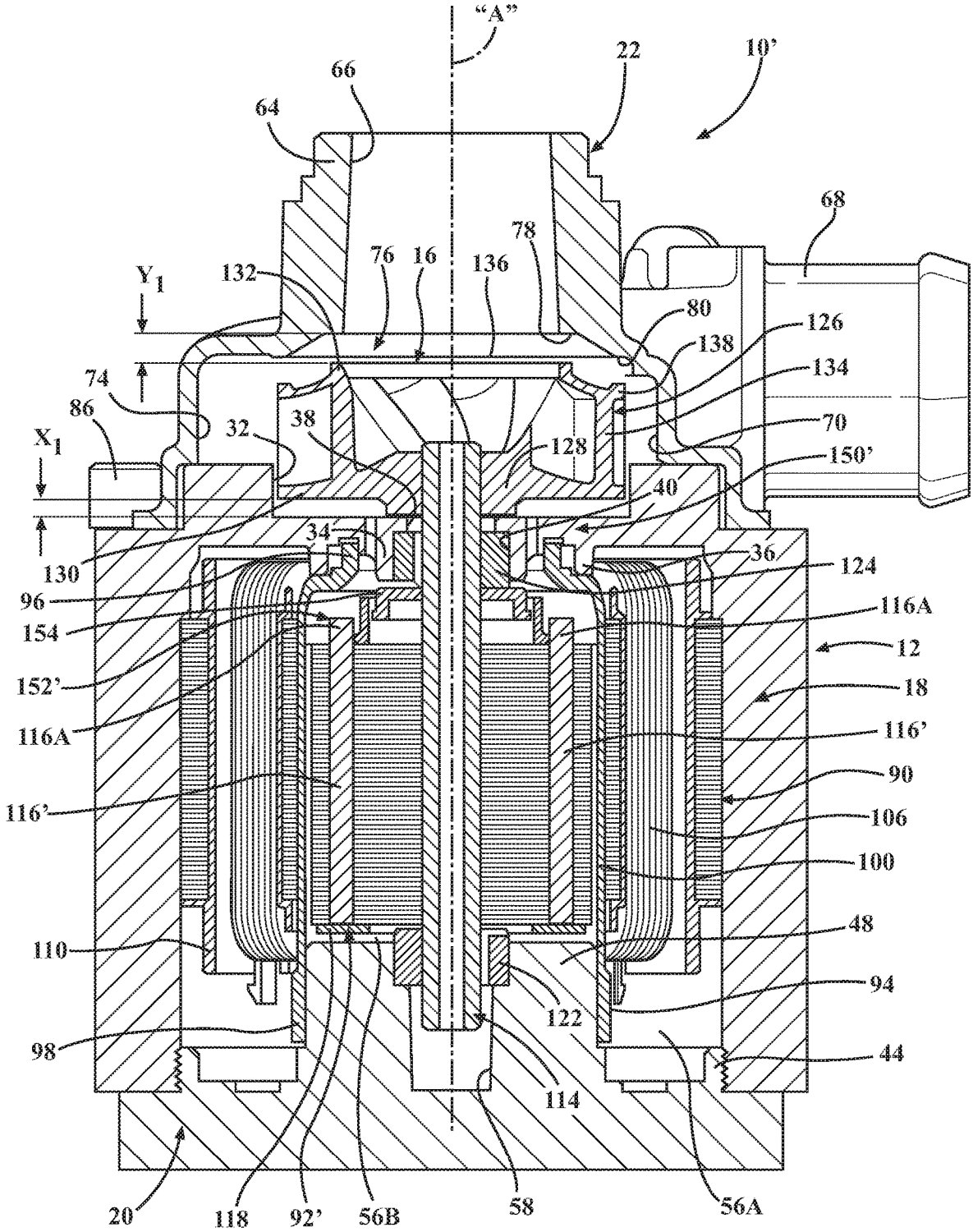
FIG. 4 is a sectional view of a variable flow electric water pump constructed in accordance with a second embodiment of the present disclosure to include a magnetically-biased rotor/impeller assembly which is shown located in a first or low flow position relative to the stationary stator assembly.
Figure 5:
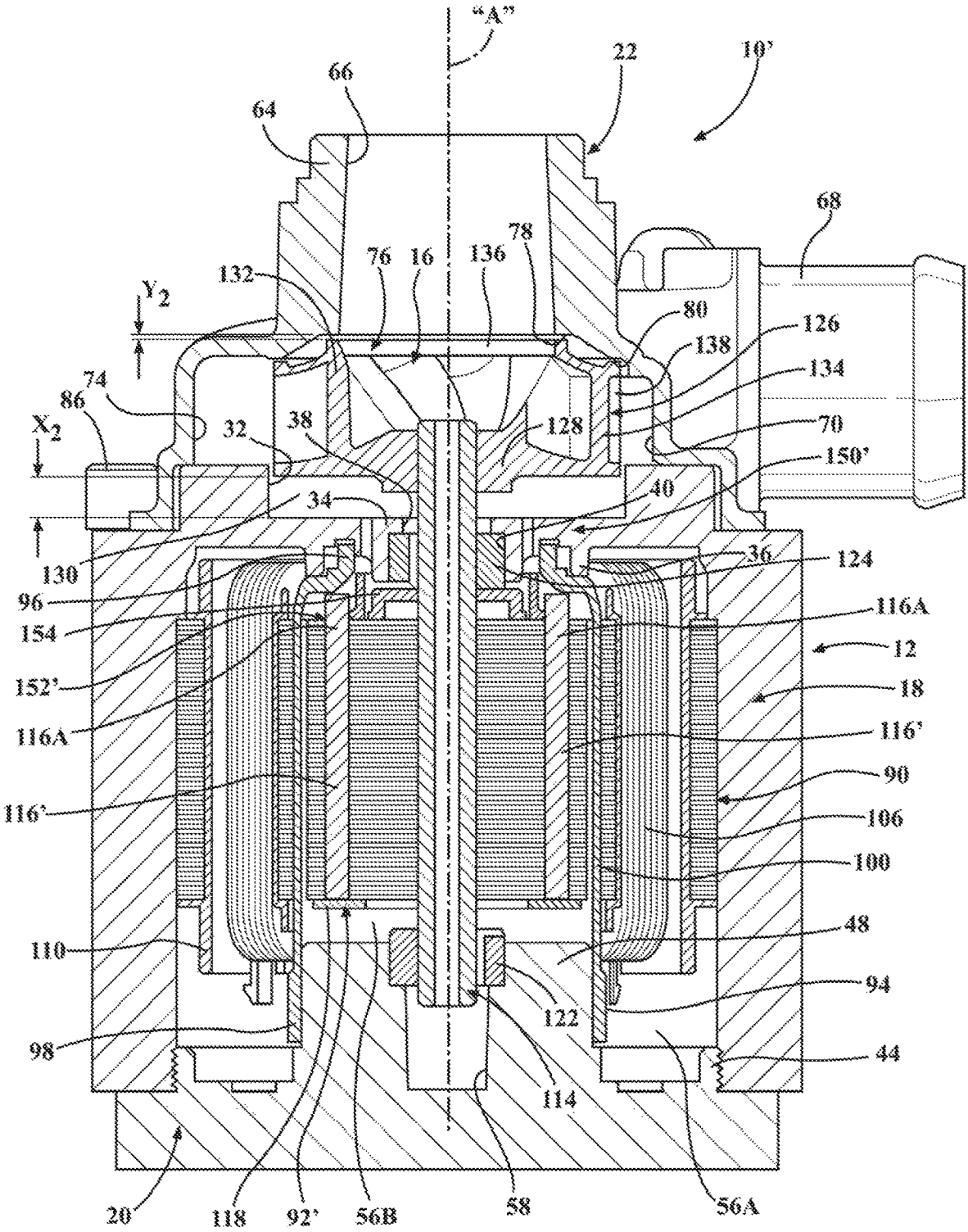
FIG. 5 is another sectional view of the variable flow electric water pump shown in FIG. 4 now illustrating the rotor/impeller assembly located in a second or high flow position relative to the stator assembly.

Referring now to FIGS. 4 and 5, a second embodiment of an electric water pump 10' constructed and functional in accordance with the present disclosure will be disclosed. Based on the similarity of a majority of the components associated with water pumps 10, 10', common reference numbers are used with the exception that primed reference numerals identified slightly modified components. In general, pump 10' does not rely on spring-biasing arrangement 152 to provide axial movement of rotor/impeller assembly 150', but rather utilizes a magnetic biasing arrangement 152' provided by an axially-offset magnetic field arrangement between rotor unit 92' and stator assembly 90. In particular, rotor unit 92' is shown equipped with a plurality of elongated magnets 116' having extended end segments 116A extending axially outwardly from the top portion of rotor unit 92'. Under normal circumstances, the center of magnets 116' will naturally align with stator assembly 90, as shown in FIG. 4, so as to locate rotor/impeller assembly 150' in the low flow position establishing clearance $X_1$, and $Y_1$, similar to those clearances associated with pump 10 of FIG. 1. As noted previously, rotor unit 92' is located in its first position relative to stator assembly 90 and impeller 126 is located in its retracted position relative to volute interface 76 when rotor/impeller assembly 150 is in its low flow position. This "self-centering" action at low rotor speeds is caused by the centering behavior of the magnetic flux associated with the generated magnetic field.

In contract to FIG. 4, FIG. 5 illustrates pump 10' when rotor unit 92' is driven at a higher speed which causes the pressure differential (ΔP) across impeller 126 to forcibly move rotor/impeller assembly 150' in an upward direction to its second or extended position, thereby establishing clearances $X_2$, $Y_2$ similar to pump 10 of FIG. 2. Again, rotor unit 92' is located in its second position relative to stator assembly 90 while impeller 126 is located in its extended position relative to volute interface 76. Thus, pump 10' provides a magnetic biasing arrangement as an option to the mechanical biasing arrangement associated with pump 10. Line "B" in FIG. 5 identifies the stator's center magnetic field aligned with the rotor's center magnetic field. The clearance "D" in FIG. 4 identifies an example amount of magnetic offset between the rotor's center magnetic field and the stator's center magnetic field.

While pump 10 was illustrated to include a helical coil spring as biasing member 156 those skilled in the art recognize that other types and/or combinations of biasing devices configured to normally bias rotor/impeller assembly 150 to its low flow position during low speed/low flow operation can be employed. In addition, a combination of the spring-biased arrangement 152 of FIGS. 1 and 2 can be integrated with the magnetic field arrangement 152' of FIGS. 4 and 5 to provide a hybrid variant of yet another embodiment of an electric water pump that is within the anticipated scope of this disclosure.

While not expressly shown, those skilled in the art will recognize that electric pumps 10, 10' would be equipped with a controller device which functions to control operation of electric motor 12 and the rotational speed of impeller 126. The controller device may include an electronic circuit board (ECB) electrically connected to stator assembly 90 and which can be mounted within pump housing 18.

Figure 6A:
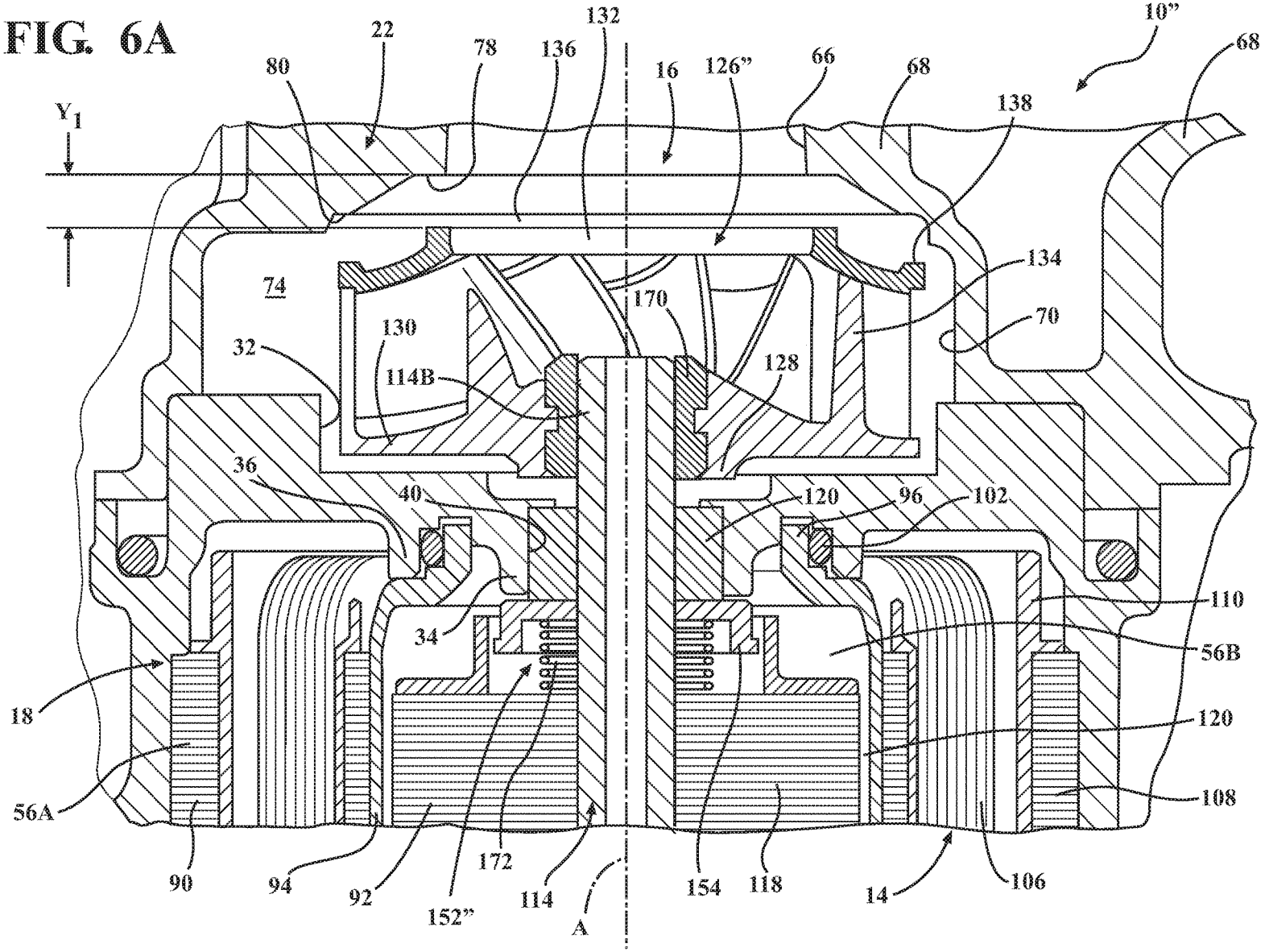
FIGS. 6A and 6B are a partial sectional view of a slightly modified version of the variable flow electric water pump of FIGS. 1 and 2.
Figure 6B:
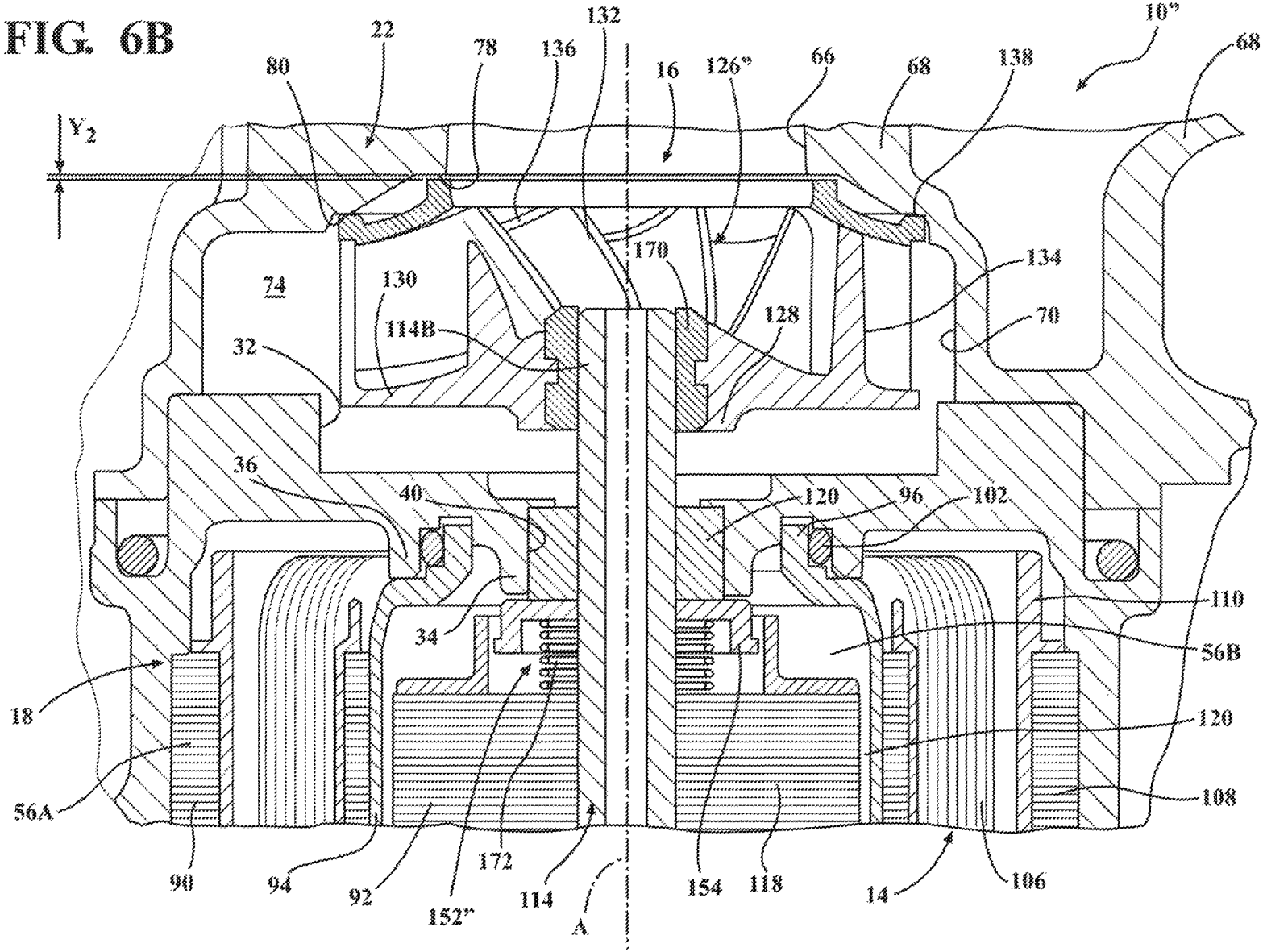

Referring to FIGS. 6A and 6B, another alternative embodiment of an electric water pump 10" is shown which is generally similar to electric water pump 10 of FIGS. 1 and 2 with the exception that impeller 126" now includes a molded-in sleeve 170 within which end portion 114B of rotor shaft 114 is pressed into. In addition, mechanical biasing arrangement 152" now includes a plurality of stacked wave or spring washers 172, such as Belleville washers, surrounding rotor shaft 114 and being disposed between a top portion of rotor unit 92 and thrust washer 154. Otherwise, the structure and function of water pump 10" is generally similar to that of water pump 10. While specific aspects, features and arrangements have been described in the specification and illustrated in the drawings, it will be understood that various changes can be made and equivalent elements be substituted therein without departing from the scope of the teachings associated with the present disclosure. Furthermore, the mixing and matching of features, elements and/or functions between various aspects of the inventive electric water pumps is expressly contemplated. Accordingly, such variations are not to be regarded as departures from the disclosure and all reasonable modifications are intended to be within the anticipated scope of the disclosure.

The invention claimed is:

1. A variable flow electric water pump for use in an engine coolant system of a motor vehicle, the electric water pump comprising:

a pump housing defining a fluid chamber, a motor chamber, a fluid inlet and a discharge port providing a flowpath for coolant flowing through said fluid chamber, and an interface established between said fluid inlet and said fluid chamber defining a flange surface;

an electric motor disposed in said motor chamber of said pump housing and including a stationary stator assembly and a rotor unit having a rotor shaft supported for rotation about a longitudinal axis and extending into said fluid chamber;

an impeller fixed to said rotor shaft for rotation in said fluid chamber and operable to pump coolant from said fluid inlet to said discharge port, said impeller having a rim surface aligned with said flange surface of said pump housing; and a biasing arrangement for normally locating said rotor unit in a first position that is axially offset relative to said stator assembly for locating said impeller in a retracted position within said fluid chamber to provide a low flow characteristic between said fluid inlet and said discharge port when said impeller is driven by said rotor shaft at a low rotor-speed, said biasing arrangement being configured to exert a preload on said rotor unit, wherein a first clearance gap is established between said rim surface of said impeller and said flange surface of said pump housing when said impeller is located in its retracted position, said fluid inlet and said discharge port being fluidly connected through said first clearance gap, said first clearance gap being configured to decrease the coolant flow rate between said fluid inlet and said discharge port, wherein rotation of said impeller at a high rotor speed causes said rotor unit to overcome said preload and move to a second position axially aligned with said stator assembly for causing said impeller to move from its retracted position into an extended position within said flow chamber to provide a high flow characteristic between said fluid inlet and said discharge port, wherein a second clearance gap is established between said flange surface of said pump housing and said rim surface of said impeller when said impeller is located in its extended position, said second clearance gap configured to increase the coolant flow rate between said fluid inlet and said discharge port, and wherein said first clearance gap is larger than said second clearance gap.

2. The electric water pump of claim 1, wherein said biasing arrangement is a mechanical biasing arrangement including a biasing member configured to exert said preload on said rotor unit.

3. The electric water pump of claim 2, wherein said biasing member is a coil spring disposed between a portion of said pump housing and said rotor unit.

4. The electric water pump of claim 1, wherein said biasing arrangement is a magnetic biasing arrangement including a plurality of magnets extending axially outwardly from said rotor unit and operable to align the center of a magnetic field associated with said rotor unit with the center of a magnetic field associated with said stator assembly for locating said rotor unit in its first position.

5. The electric water pump of claim 1, wherein said rotor shaft is axially moveable relative to said pump housing and has a first end slideably and rotatably supported by a first guide bushing and a second end slideably and rotatably supported by a second guide bushing.

6. The electric water pump of claim 1, wherein a pressure differential established across said impeller in response to increasing rotor speed is operable to cause said impeller to move from its retracted position into its extended position, and wherein such axial movement of said impeller causes concurrent axial movement of said rotor unit relative to said stator assembly from its first position into its second position.

7. The electric water pump of claim 1, wherein a pressure differential established across said impeller in response to increasing rotor unit speed is operable to cause said impeller to move from its retracted position into its extended position, and wherein such axial movement of said impeller causes concurrent axial movement of said rotor unit relative to said stator assembly from its first position into its second position.

8. The electric water pump of claim 1, wherein said first clearance gap and said second clearance gap are established between said rim surface of said impeller and said flange surface of said pump housing in a direction of said longitudinal axis.

* * * * *